US006575778B1

(12) United States Patent
Milette et al.

(10) Patent No.: US 6,575,778 B1
(45) Date of Patent: Jun. 10, 2003

(54) PUNCH DOWN INSULATION DISPLACEMENT CONNECTOR HOUSING

(75) Inventors: Luc Milette, Montreal (CA); Benoit Chevarie, Boisbriand (CA)

(73) Assignee: Nordx/CDT, Inc., Pointe-Claire (CA)

( * ) Notice: Subject to any disclaimer, the term of this patent is extended or adjusted under 35 U.S.C. 154(b) by 0 days.

(21) Appl. No.: 09/286,114

(22) Filed: Apr. 2, 1999

Related U.S. Application Data

(60) Provisional application No. 60/110,738, filed on Dec. 3, 1998.

(51) Int. Cl.[7] ..... H01R 4/24
(52) U.S. Cl. ..... 439/395; 439/396
(58) Field of Search ..... 439/392, 395, 439/404, 396, 397, 398, 399, 401, 402, 403, 676; 29/566.4, 770

(56) References Cited

U.S. PATENT DOCUMENTS 5,096,442 A 3/1992 Arnett et al. ..... 439/676
5,186,647 A 2/1993 Denkmann et al. ..... 439/395
5,580,270 A 12/1996 Pantland et al. ..... 439/395
5,720,625 A * 2/1998 Albeck et al. ..... 439/404
5,951,319 A 9/1999 Lin

* cited by examiner

*Primary Examiner*—Alexander Gilman
(74) *Attorney, Agent, or Firm*—Wolf, Greenfield & Sacks, P.C.

(57) ABSTRACT

A punch down insulation displacing connector housing is a body made of plastic which surrounds the connector. The housing restrains the connector parts from longitudinal movement when the connector is positioned to be press fit onto or to be soldered onto a substrate such as a printed circuit board. The housing also aligns the opening of the connector with an opening slot on the body. Thus, the housing aligns a connection tool head used to insert a wire with the opening of the connector. This housing will stop movement of the connection tool head during wire insertion to position the wire inside the connector at a desired position. Also, the housing offers a surface where the connection tool head will stop and cut the wire. This housing is used on a compact electrical connector and will surround the connector. The housing can accept various types of connection tool head.

11 Claims, 19 Drawing Sheets

PUNCH DOWN INSULATION DISPLACEMENT CONNECTOR HOUSING

This application claims the benefit of Provisional Application No. 60/110,738, filed Dec. 3, 1998.

BACKGROUND OF THE INVENTION

1. Field of the Invention

The present invention relates to housings for punch down insulation displacement connectors. The invention relates more particularly to housings compatible with plural insertion tools.

2. Related Art

A punch down insulation displacement connector (punch down IDC) is a type of cable termination connector in common use throughout the telecommunications and data communications industries. The name describes the operation of the connector. The term "insulation displacement" refers to cutting or displacement of insulation on unstripped wires by a conductive connector element which makes contact with the wires within the insulation jacket. When used in insulation displacement connectors, the wires are unstripped, each retaining its insulation jacket, thus avoiding any inadvertent contact between exposed wires. The term "punch down" refers to the act of pressing the wires down into the connector body to make each desired connection. When a wire is "punched down" into a punch down IDC, the wire is gripped and electrical connection made thereto by internal conductive connector elements.

There are presently three principle mutually incompatible types of punch down IDC housing, each designed for use with a different specific connection tool head. The first connection tool, manufactured by KRONE AG, Germany, is used for a unique IDC housing design described in U.S. Pat. No. 5,580,270. Another type is the type 110 punch down IDC housing made by AT&T, and described in U.S. Pat. Nos. 5,096,442 and 5,186,647. The third principle type is the BIX punch down IDC housing, described in U.S. Pat. No. 4,909,754. BIX is a registered trademark of Northern Telecom Limited Corporation. Housing designs are also known which are adapted to accept in the same housing both the type 110 (AT&T) and KRONE design. But no single housing is known which can be used with all three types of connection tool. Such a combination was not thought possible due to the incompatible profiles and requirements of the various tools.

SUMMARY OF THE INVENTION

The present invention can be embodied in an insulation displacement connector comprising: a dielectric body having defined thereon a rib longitudinally oriented parallel to a slot defined in the housing through which the wire is inserted, the rib defining a surface on which the wire will be positioned and cut; a first region symmetrically defined by first inside edges and first corners used to guide and retain the wire and used to guide a first tool head having a first set of features and to guide a second tool head having a second set of features; a second region symmetrically defined by second inside edges and second corners used to guide and retain the wire and used to guide a third tool head having a third set of features, the second symmetrical region not interfering with the features of the first tool head or the features of the second tool head; and a third region defined between the first and second regions, the insulation displacement connector received inside the third region.

BRIEF DESCRIPTION OF THE DRAWINGS

In the drawings, in which like reference designations indicate like elements.

DETAILED DESCRIPTION

The present invention will be better understood upon reading the following detailed description of embodiments thereof, in connection with the figures.

An embodiment of a single punch down IDC housing compatible with all three principle tool types, the KRONE, BIX and AT&T type 110 tools, is now described.

Figure 3:
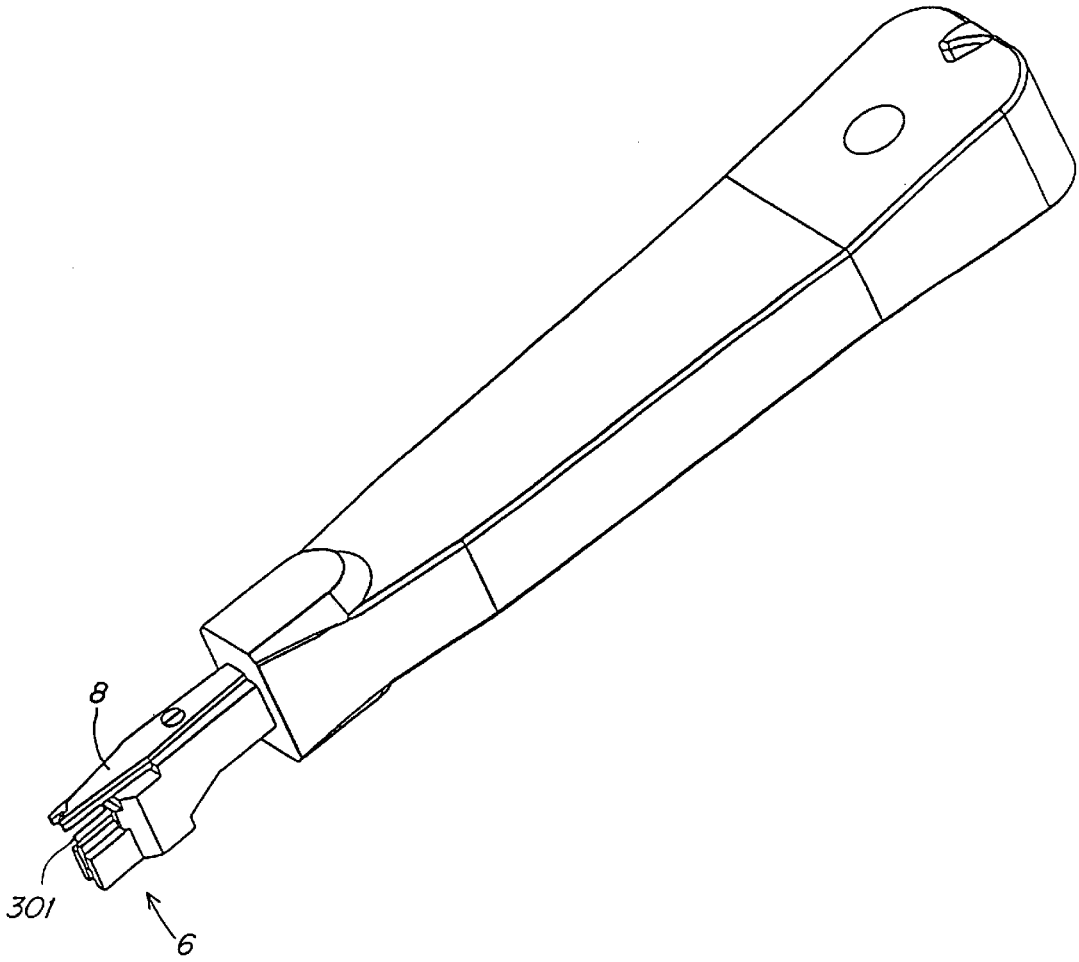
FIG. 3 (PRIOR ART)
FIG. 3 is a perspective view of a prior art tool head manufactured by KRONE.

The KRONE tool is shown in FIG. 3. The head 6 of the KRONE tool includes ribs 301, which guide the tool into a housing and press a wire into place during an insertion operation, and also includes a cutter 8, which is activated when the inserted wire reaches a final position. These features are described in greater detail below, in connection with the interaction between the tool and the housing of the described embodiment. At this point, note that the shapes of ribs 301 key the tool to the housing with which it can be used.

Figure 4:
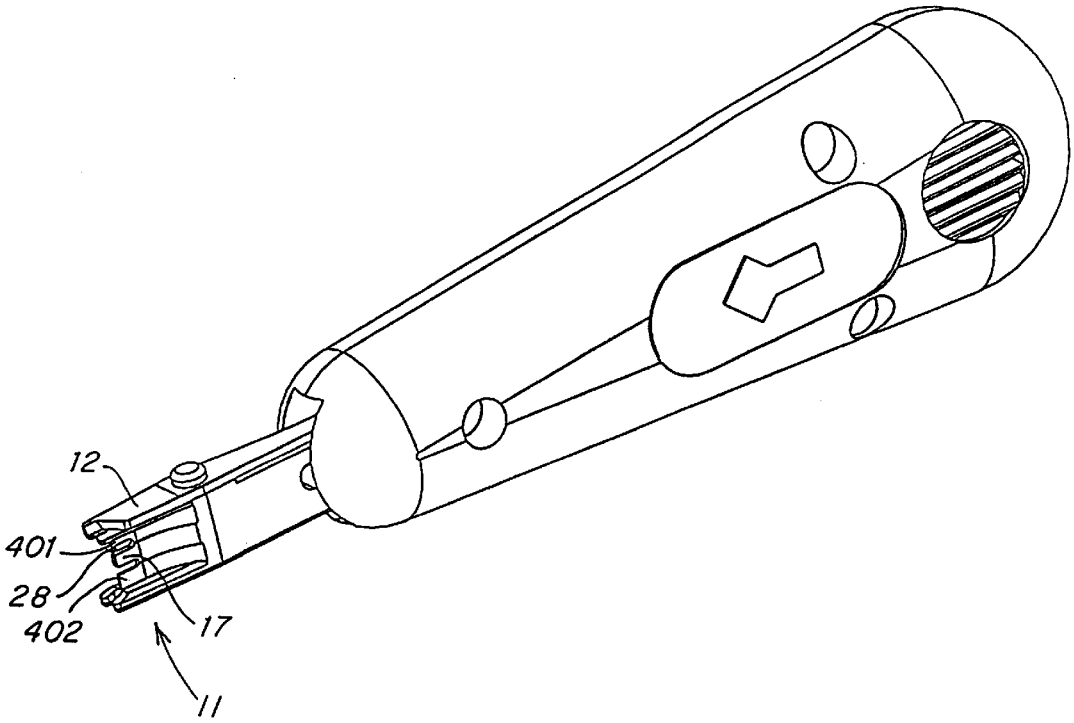
FIG. 4 (PRIOR ART)
FIG. 4 is a perspective view of a prior art tool head manufactured by BIX.

The BIX tool is shown in FIG. 4. The BIX tool head 11 includes posts 401, 402, and 17, a slot 28 and a cutter 12, which is activated when the inserted wire is pressed by posts 401, 402 and 17 into a final position. Again, the features of this tool are described in greater detail below, in connection with the interaction between the tool and the housing of the described embodiment. In this tool, the shapes of posts 401, 402 and 17 key the tool to the housing with which it can be used.

Figure 5:
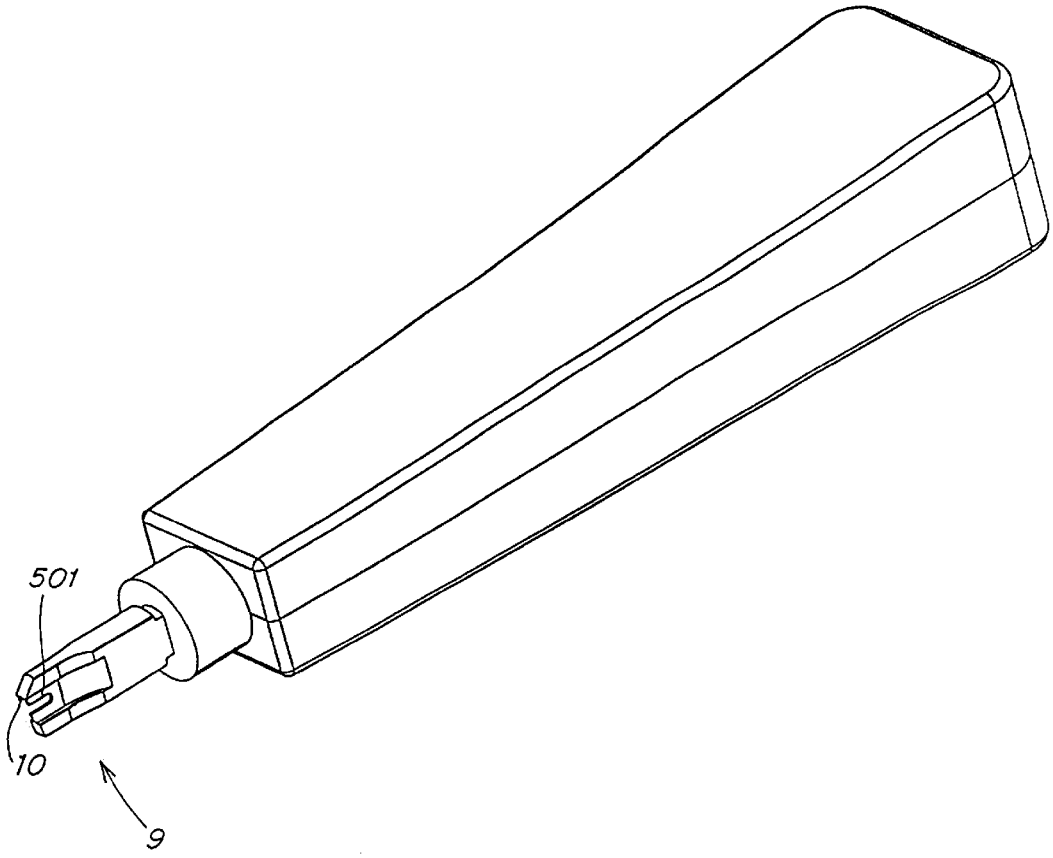
FIG. 5 (PRIOR ART)
FIG. 5 is a perspective view of a prior art tool head of type 110 manufactured by AT&T.

Finally, the AT&T type 110 tool is shown in FIG. 5. The type 110 tool head 9 includes ribs 501 and a cutting edge 10, which cuts a wire which has been pressed by ribs 501 into a final position. Yet again, the features of this tool are described in greater detail below, in connection with the interaction between the tool and the housing of the described embodiment. In this tool, the shapes of ribs 501 key the tool to the housing with which it can be used.

Figure 6:
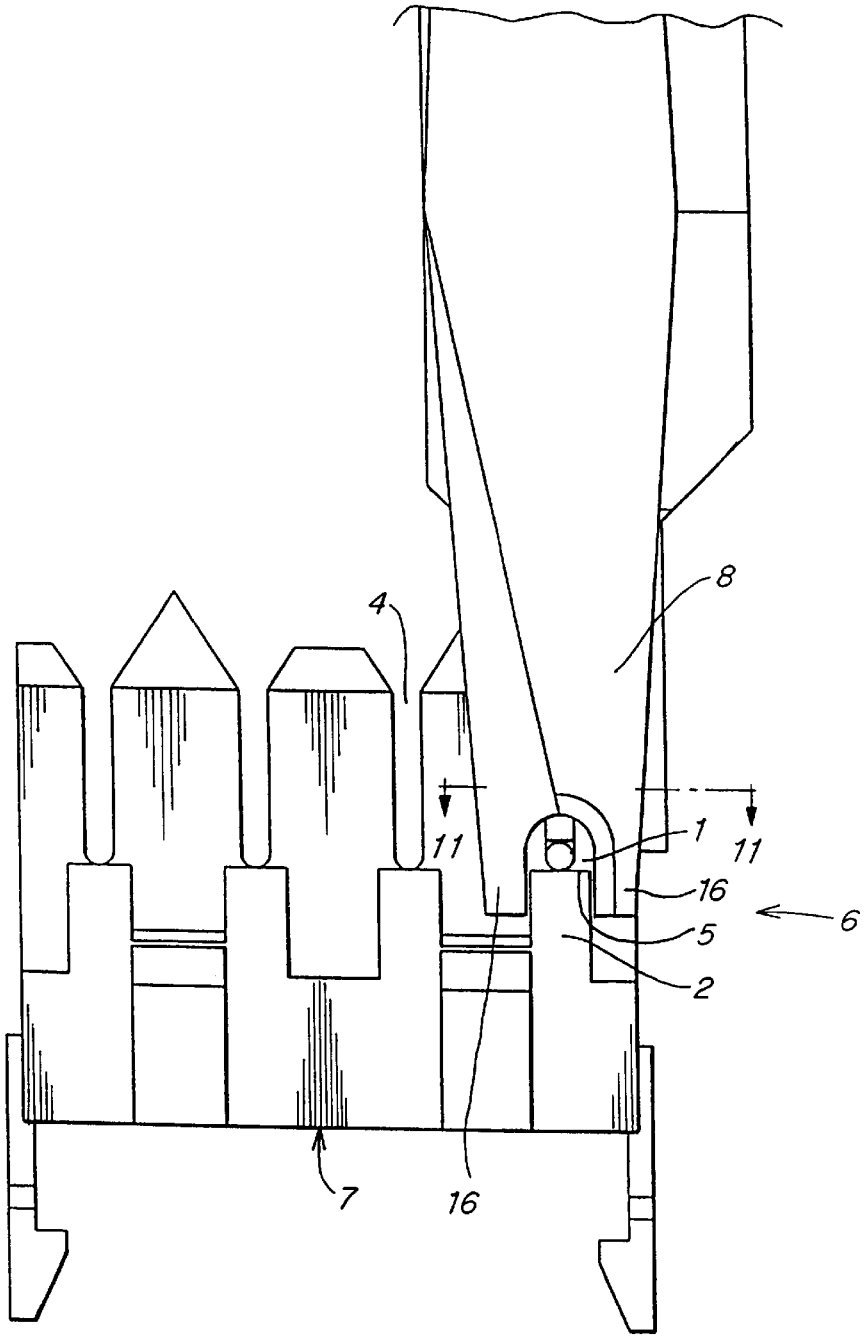
FIG. 6 illustrates the final position of the KRONE tool head in a housing embodying the invention during a wire insertion operation.
Figure 14:
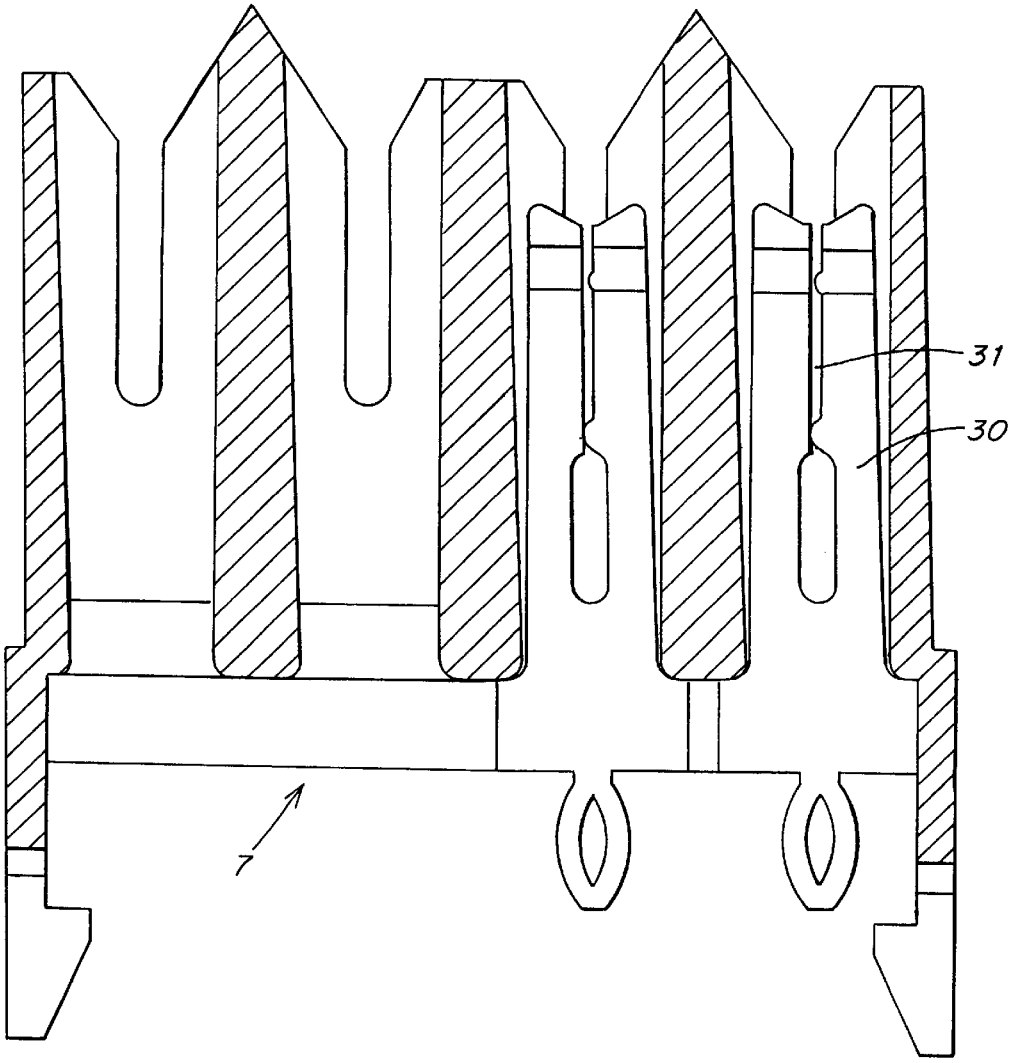
FIG. 14 is a cross-sectional view through part of the housing taken along line 14—14 of FIG. 11

FIG. 6 shows a side view of the exemplary housing embodiment described herein, with the KRONE tool head 6 illustrated in cutting position. The slot 1 of the tool head 6 fits over the rib 2 of the housing 7. When making the wire connection, the tool head 6 pushes down the wire 3 inside the slot 4 of the housing connector 7 and inside a slot 31 in connective elements 30 of the connector (see also FIG. 14). The tool stops pushing the wire further in when the wire 3 touches the cutting anvil 5 of the housing 7. At this final position, cutter 8 of the tool head 6 can cut the wire 3, which is being held at the cutting anvil 5.

Figure 7:
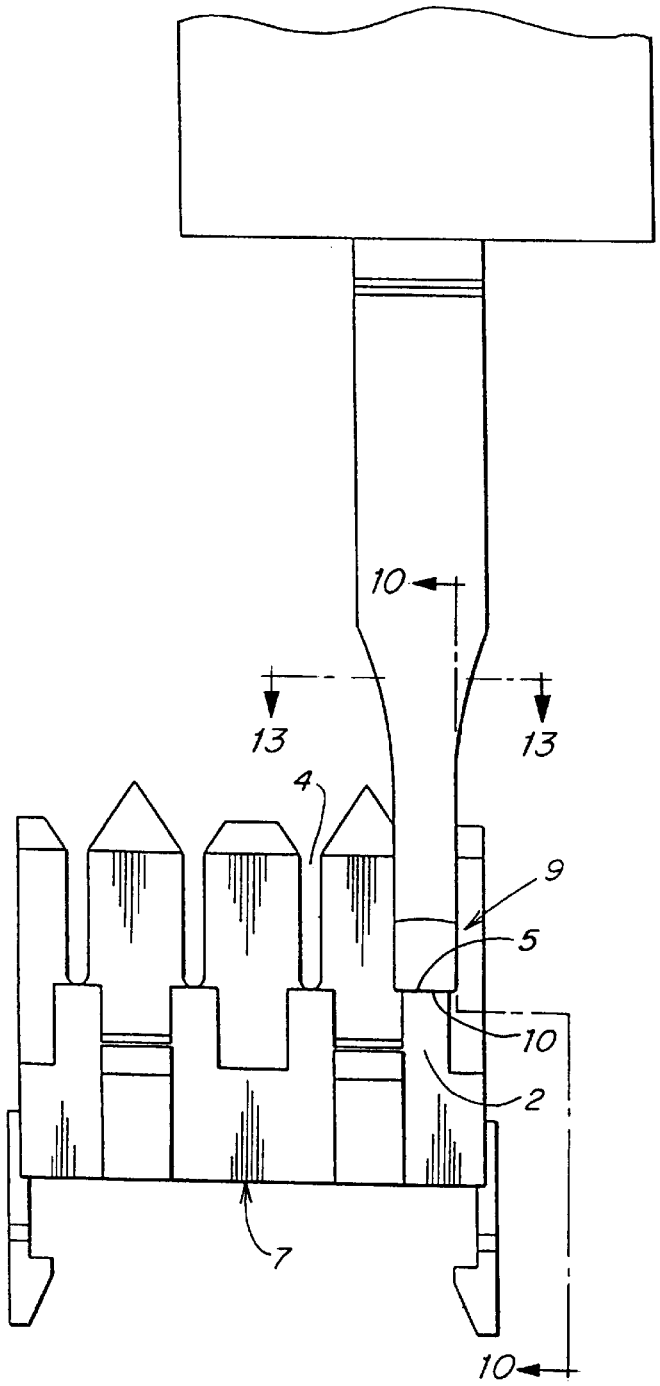
FIG. 7 illustrates the final position of the type 110 tool head in a housing embodying the invention during a wire insertion operation.

FIG. 7 is a side view of the housing 7 with a type 110 tool head 9 in cutting position. The type 110 tool head 9 will push down the wire 3 inside the slot 4 and inside the slot (FIG. 14, 31) of the IDC (FIG. 14, 30) and when the wire 3 reaches the cutting anvil 5 at the top of rib 2, the cutting edge 10 of the tool head 9 will cut the wire 3.

Figure 8:
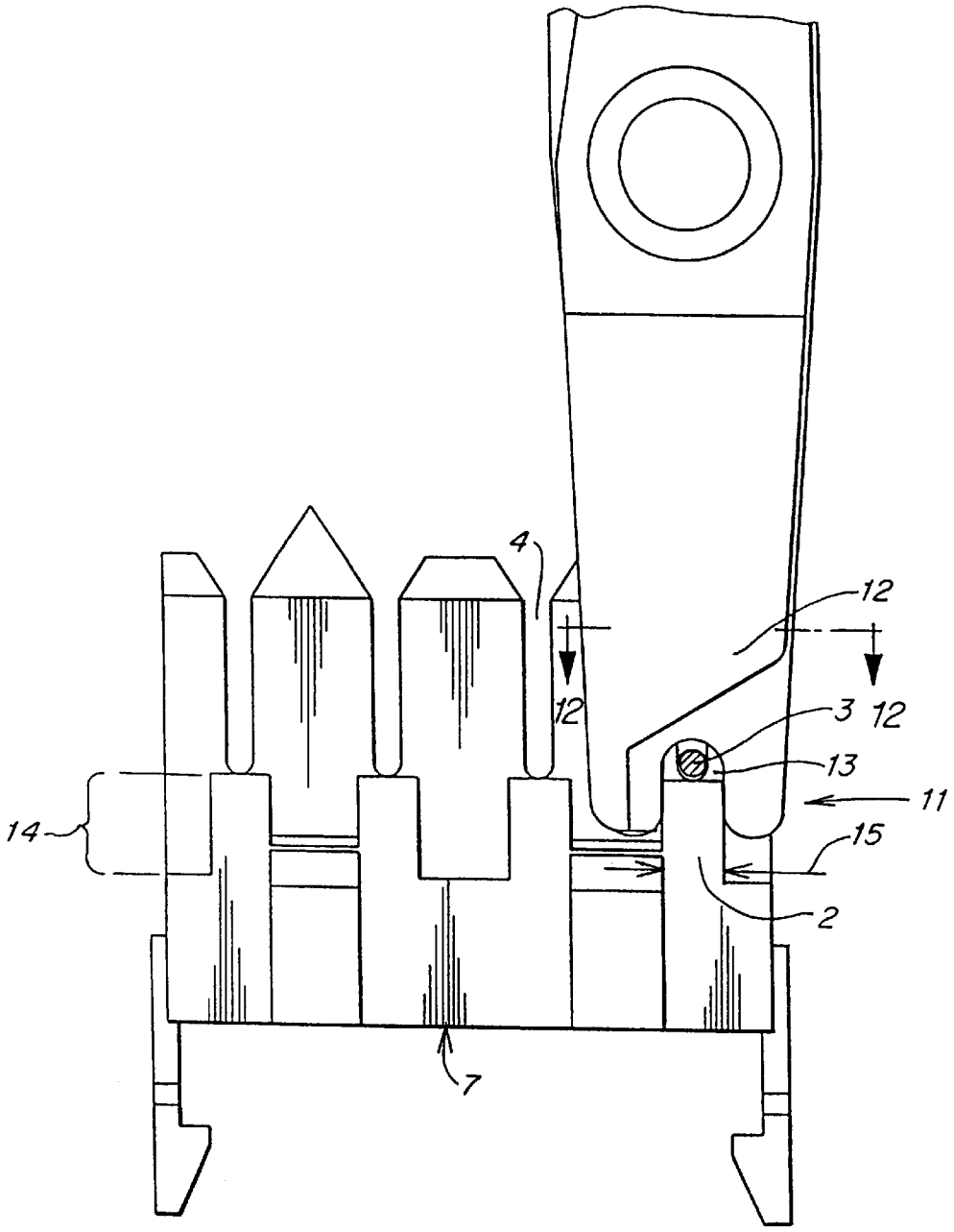
FIG. 8 illustrates the final position of the BIX tool head in a housing embodying the invention during a wire insertion operation.

FIG. 8 is a side view of the housing 7 with a BIX tool head 11 in cutting position. The slot 13 of the BIX tool head 11 fits over the rib 2 of the housing 7. The BIX tool head 11 will push down the wire 3 inside the slot 4 and inside the slot (FIG. 14, 31) of the IDC (FIG. 14, 30) and when the wire reaches the cutting anvil 5 on top of the rib 2, the internal mechanism (not shown) of the BIX tool 11 will activate the cutter 12 and cut the wire 3.

As shown in FIG. 8, width 15 defines rib 2. Width 15 lies between about 0.057 inch maximum and 0.040 inch minimum. The minimum value of width 15 provides enough surface at the top of rib 2 to support and cut the wire with efficiency when using the type 110 tool head (FIG. 7, 9). The height 14 of rib 2 has a minimum value of 0.070 inch to provide clearance for the two legs (FIG. 6, 16) of the KRONE tool head 6 on each side of the rib 2 while the wire 3 lies on the top surface 5 of rib 2. There is no maximum value for the height 14.

The dimensions defined herein are simply one set of workable dimensions for the housing. Other dimensions will work, as will be seen by the skilled artisan.

Figure 9:
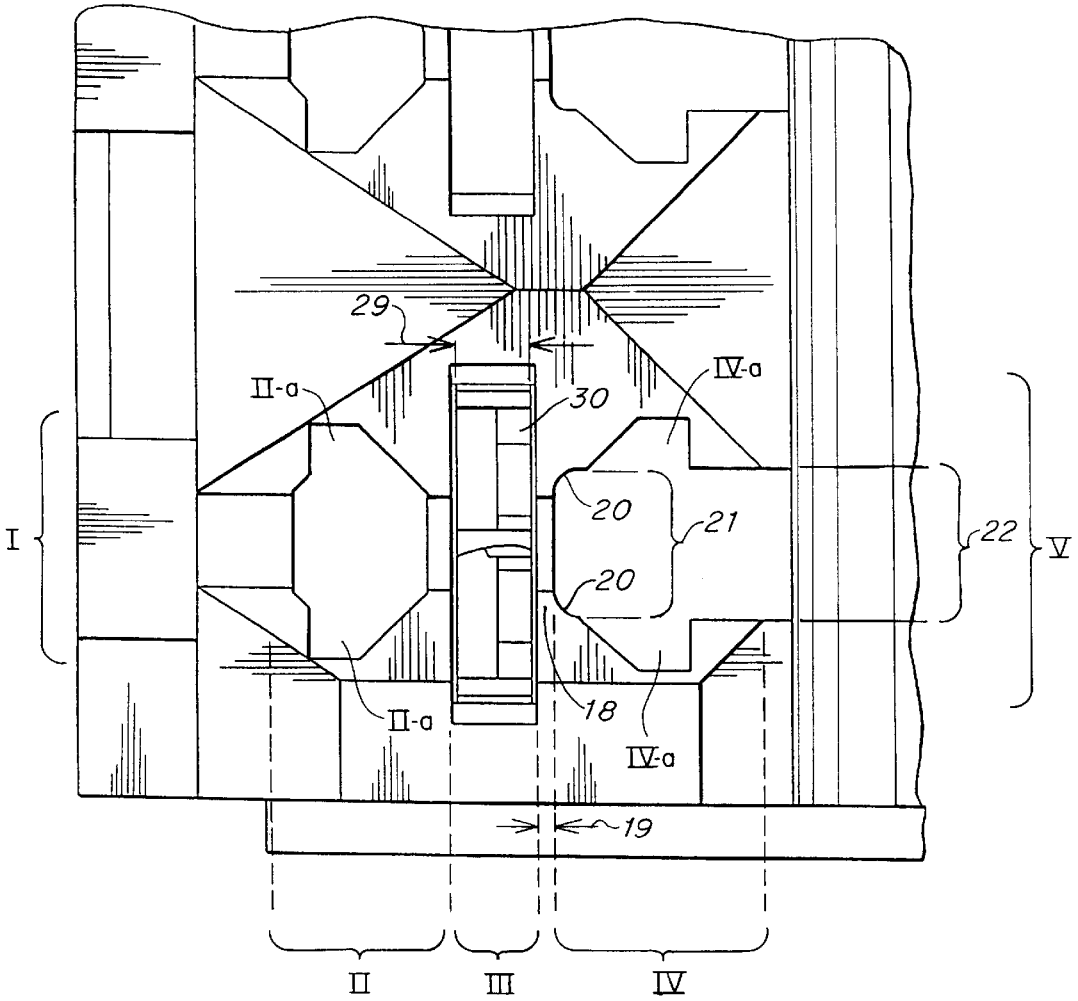
FIG. 9 is a top view, i.e., a plan view, of a detail of an embodiment of the invention.
Figure 10:
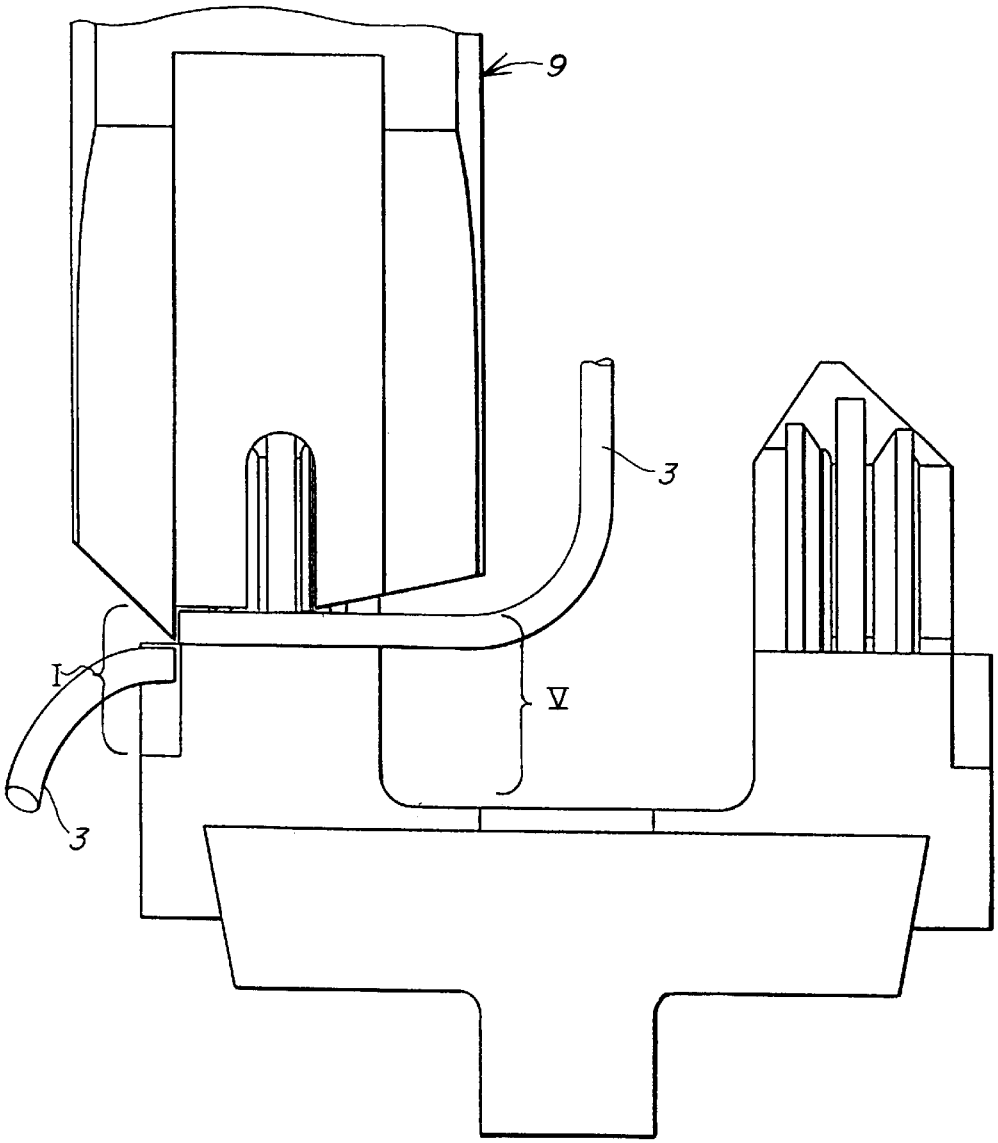
FIG. 10 is a cross-sectional view through part of the housing taken along line, 10—10 of FIG. 7 and to a larger scale.

FIG. 9 is a top view of a detail of the housing described above. Five regions are indicated by Roman numerals I–IV. The regions define a variety of surfaces or voids which engage the wire or insertion tools in various ways. The end of a length of wire to be terminated in the illustrated connector approaches the connector from the Region V side and traverses the housing from Region V to Region I. The end is cut in Region I, as previously described. FIG. 10 shows an insertion tool 9 in position to insert and cut a wire 3 in the housing. The tool 9 cuts the end of wire 3 in Region I; the remaining wire appends the housing from Region V. Consider, again, FIG. 9. Region III is the location of the conductive connector components which engage the wire and displace the insulation. Regions II and IV define surfaces which align the tool head and also which guide and retain the wire into its final position for cutting.

Figure 11:
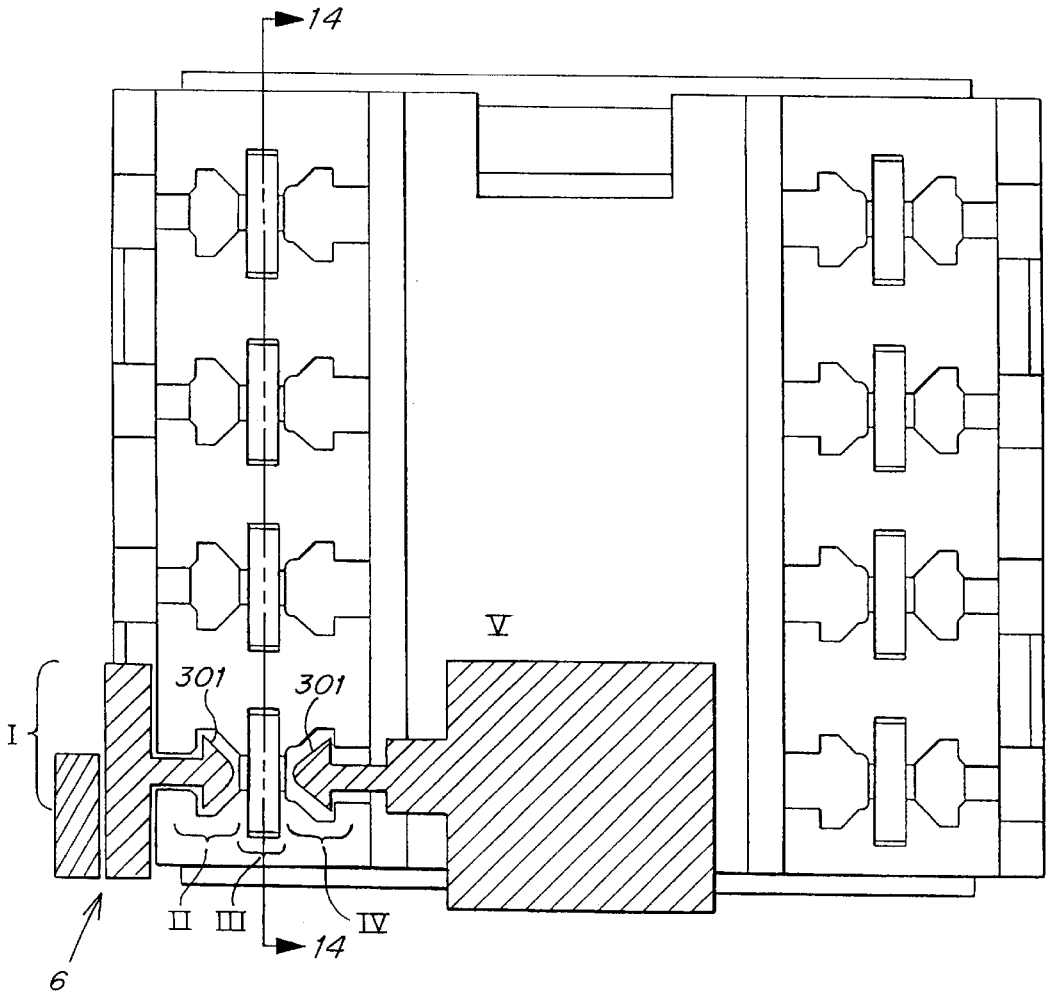
FIG. 11 is a cross-sectional view through part of the housing taken along line 11—11 of FIG. 6 and to a larger scale.
Figure 12:
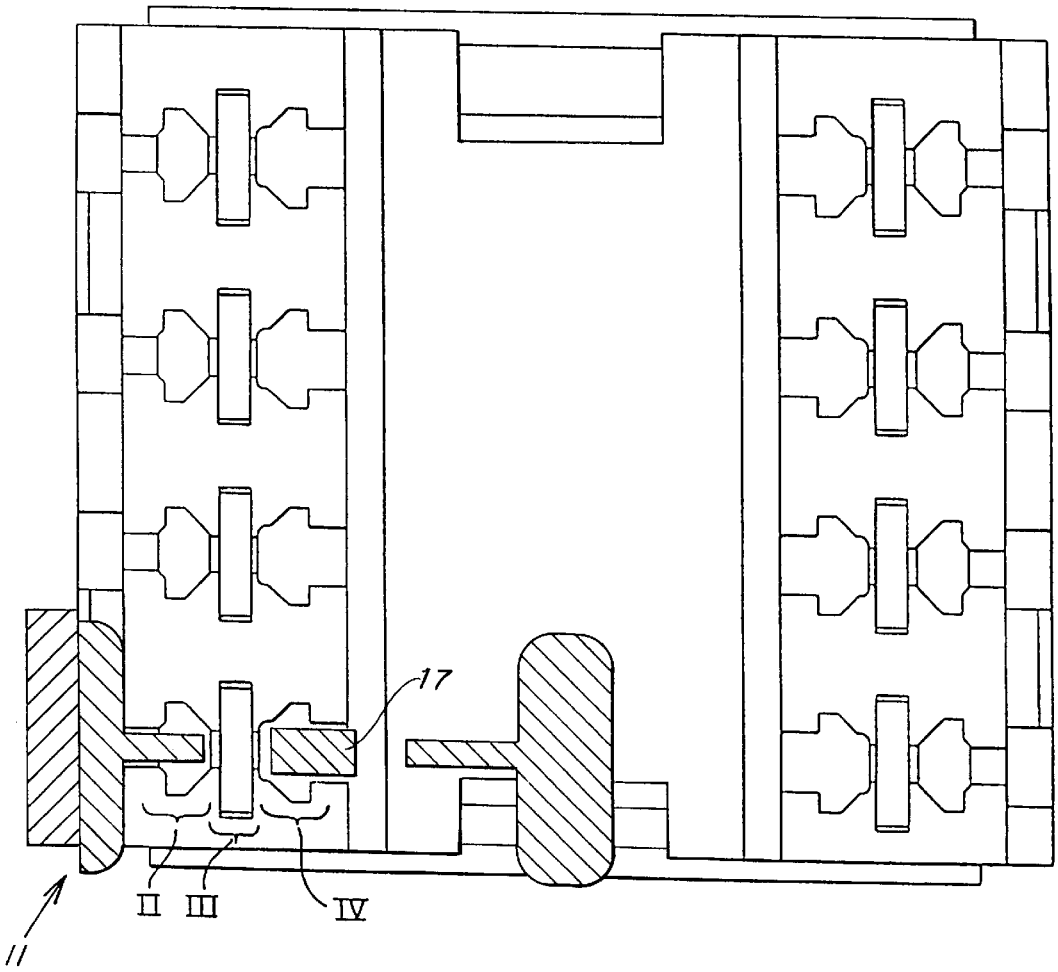
FIG. 12 is a cross-sectional view through part of the housing taken along line 12—12 of FIG. 8 and to a larger scale.
Figure 13:
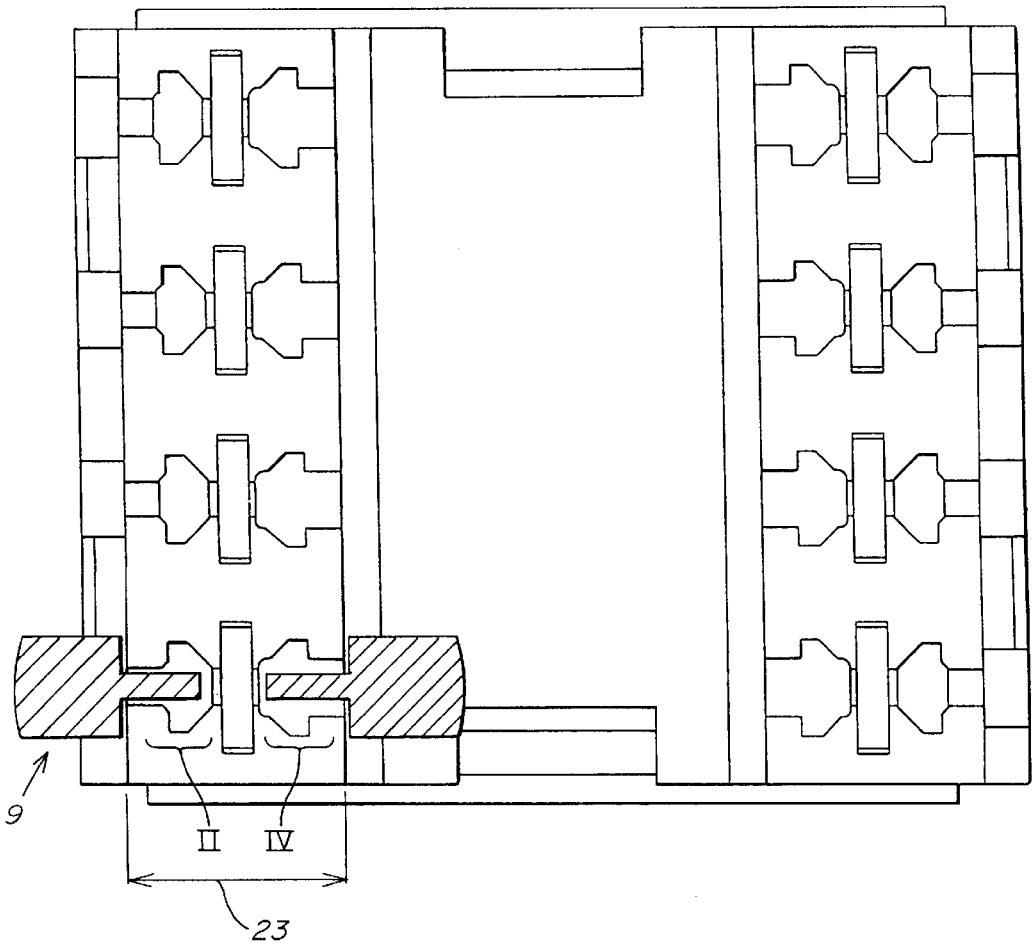
FIG. 13 is a cross-sectional view through part of the housing taken along line 13—13 of FIG. 7

Region II defines a shape which accepts two kinds of tool heads: the KRONE tool head (see FIG. 11) and the type 110 tool head (see FIG. 13). The KRONE and type 110 tool heads do not interact with or interfere with the structure of Region IV. However, Region IV has a shape which aligns the BIX tool head 11 (see FIG. 12) by positioning the central post 17 of the tool head 11. In FIG. 9, Region IV is defined away from Region III by a thickness 19 of 0.005 inch. Region further is defined by an opening 21 of 0.045 inch with a corner 20 having a radius of 0.005 inch, and a tool head guide slot 22 of 0.045 inch. Thickness 19 can vary between 0.003 inch and 0.007 inch. A thickness of 0.003 inch is the smallest which may presently be produced using a practical production process. A thickness of 0.007 inch is the maximum which does not interfere with the BIX tool head. Opening 21 and slot 22 can have minimum widths of 0.043 inch without interfering with the tool head central post (FIG. 12, 17). However, the width should not exceed 0.047 inch to ensure good alignment. The corner 20 can theoretically have a zero radius, but a zero radius adversely affects the mechanical strength of the rib 18. The radius of the corner 20, given the above-defined dimensions, should not exceed 0.010 inch, in order to avoid interference with the BIX tool head 11.

Figure 1:
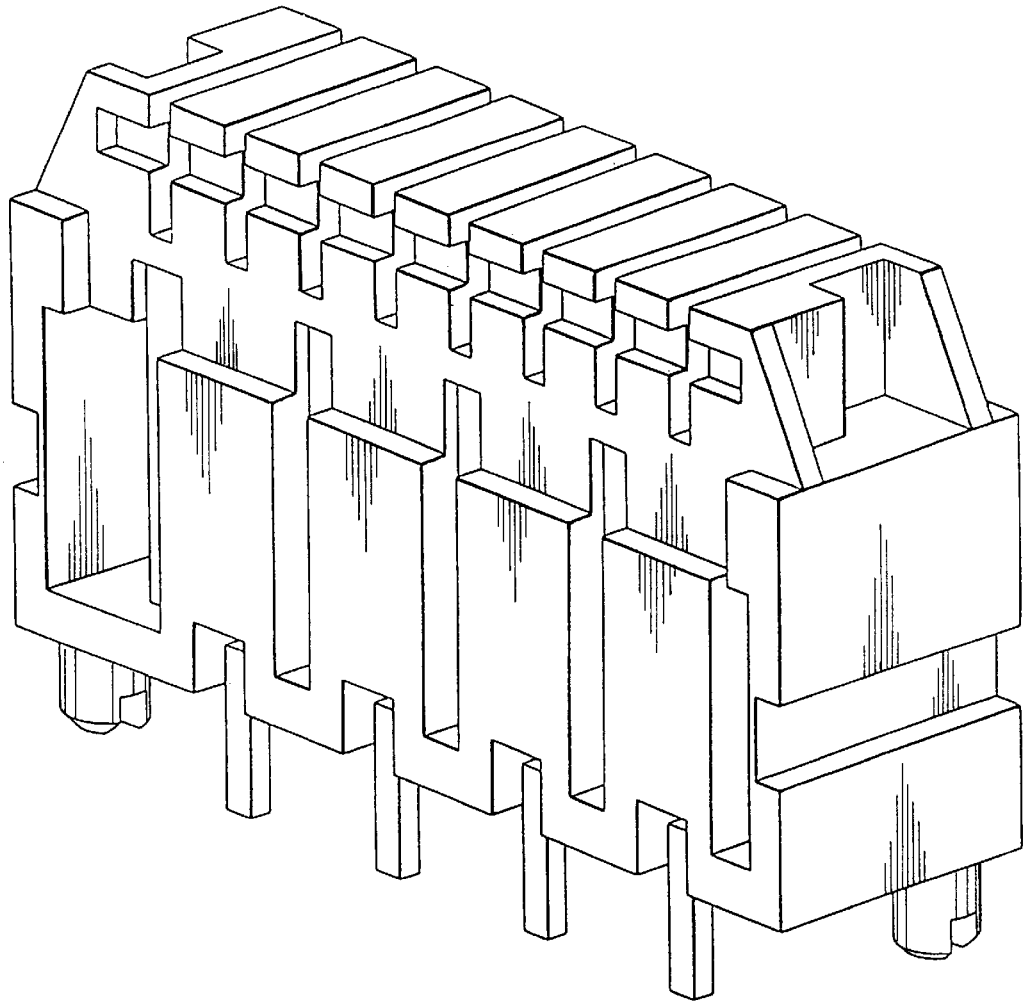
FIG. 1 (PRIOR ART)
FIG. 1 is a front perspective view of a prior art electrical insulation displacement connector housing.
Figure 2:
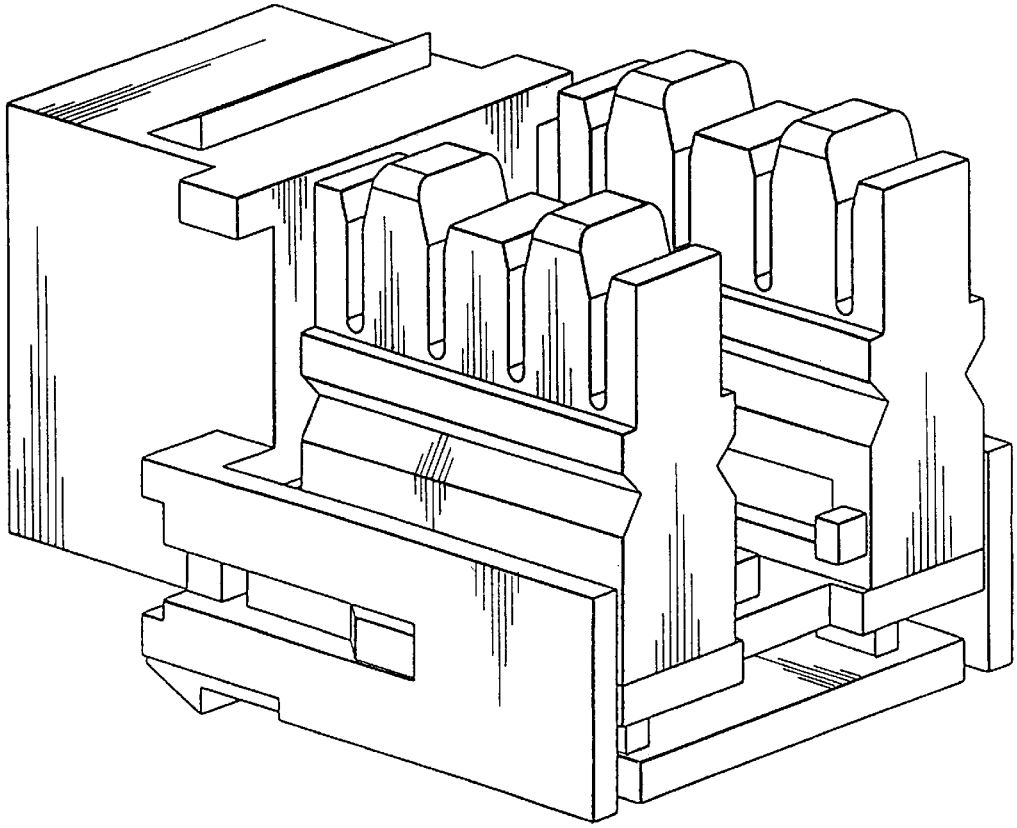
FIG. 2 (PRIOR ART)
FIG. 2 is a rear perspective view of a prior art compact electrical connector.

Region IV includes wing Regions IV-a, while Region II includes wing Regions II-a. Wing Regions IV-a are symmetrical, mirror images of each other, as are wing Regions II-a, all of which together guide the KRONE tool head 6 (see FIG. 1l). Region III defines a slot which holds the conductive insulation displacement elements 30. This region has a width 27 of 0.025 inch. The maximum width which will not interfere with the tool head slot (FIG. 4, 28) of the BIX tool head (FIG. 4, 11) is 0.028 inch. The minimum value used in this embodiment is 0.023 so as to accept conductive insulation displacement elements 30 having width 29 of 0.022 inch. Other conductive insulation displacement elements having smaller widths 29 can be used, for example as small as 0.012 inches. In FIG. 13, the dimension 23 is defined to accept and guide the tool head 9 of type 110. This dimension is similar to other electrical connector housings used with the type 110 tool head.

Figure 15:
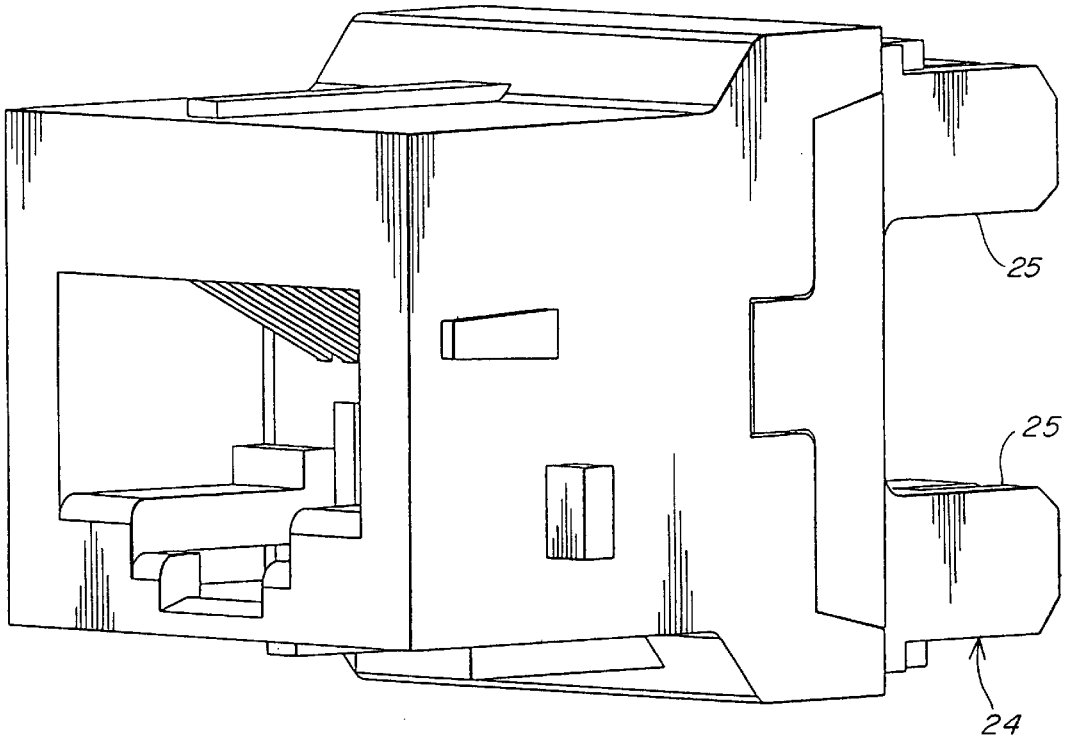
FIG. 15 discloses a front side perspective view of an electrical connector in accordance with this invention.
Figure 16:
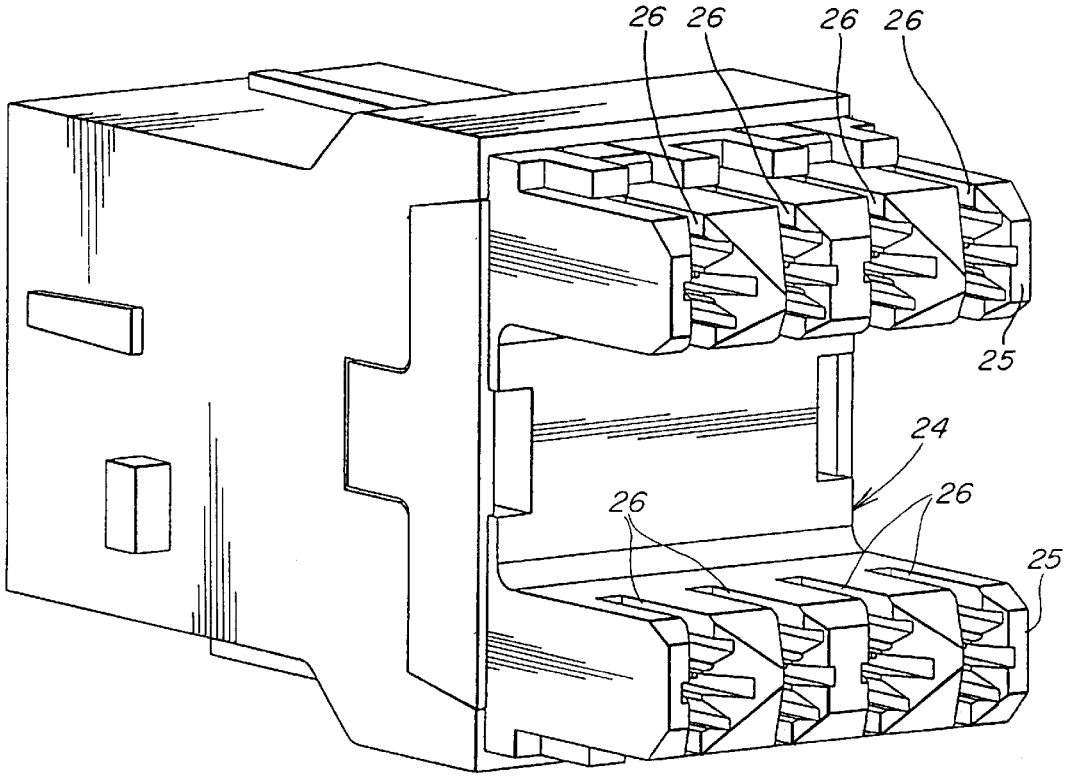
FIG. 16 discloses a rear side perspective view of an electrical connector in accordance with this invention.
Figure 17:
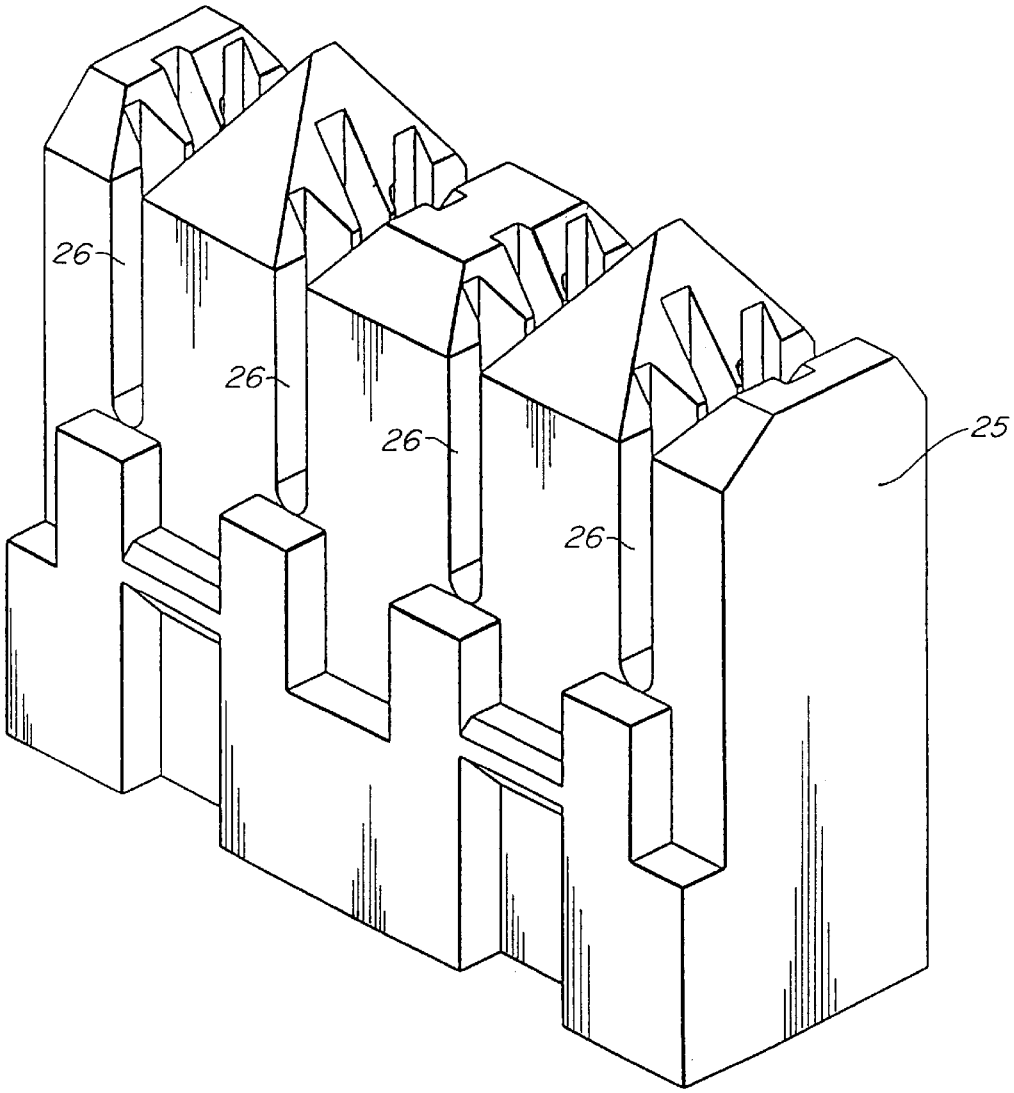
FIG. 17 discloses a second embodiment of the housing in accordance with the invention.
Figure 18:
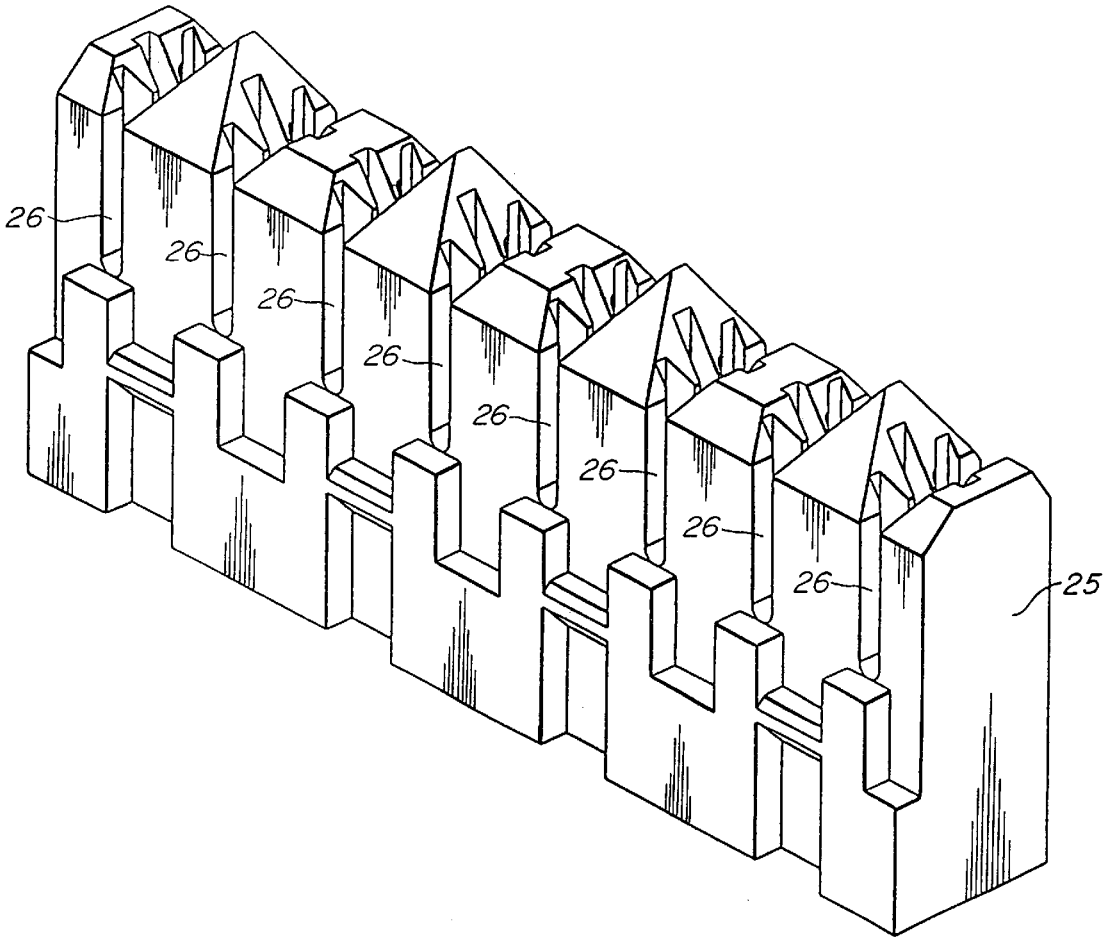
FIG. 18 discloses a third embodiment of the housing in accordance with the invention.
Figure 19:
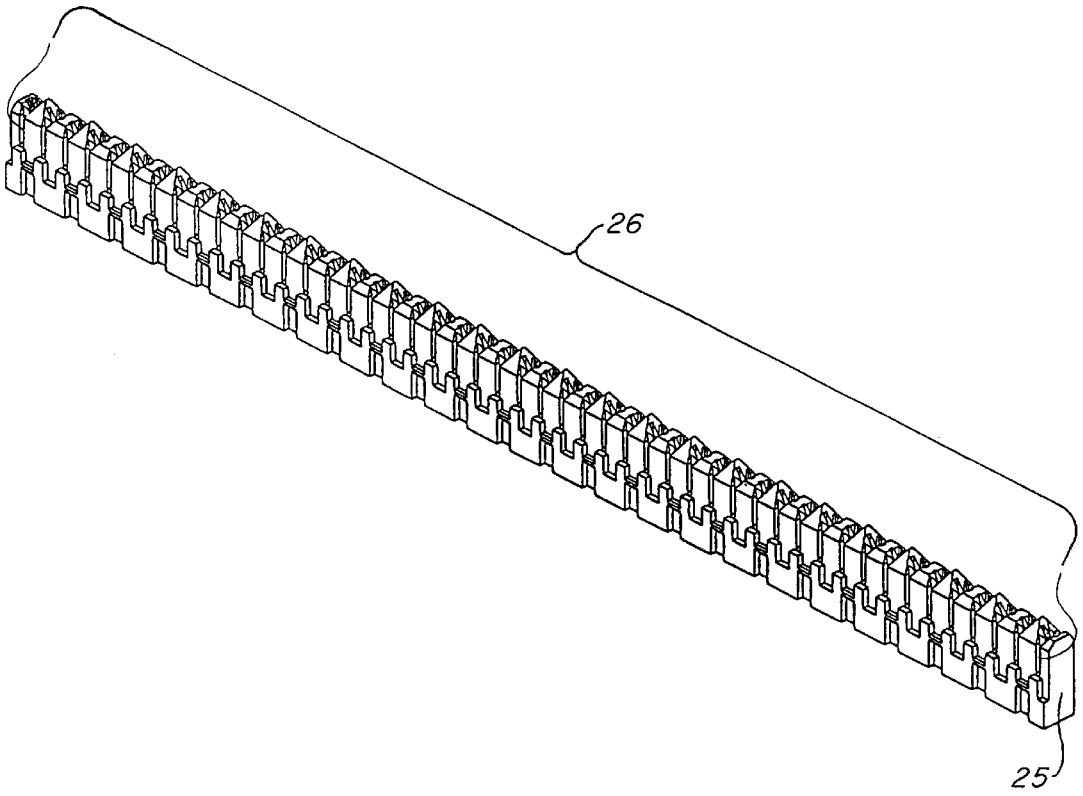
FIG. 19 discloses a fourth embodiment of the housing in accordance with the invention.

As shown in FIGS. 15 and 16, the exemplary embodiment of the invention is a housing 24 configured in two rows 25, and each row 25 having four slots 26 for wire connection to individual conductive insulation displacement elements. FIG. 17 shows another embodiment of a housing in accordance with this invention. This embodiment has only one row 25 with four slots 26 for wire connection. The FIG. 18 shows another embodiment. It is a housing with one row 25 with eight slots 26 for wire connection. FIG. 19 shows yet another embodiment in accordance with this invention. It is built with one row 25 with twenty four slots 26 for wire connection. Other configurations of rows and numbers of slots in each row are possible, as will be evident to the skilled artisan.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto.

What is claimed is:

1. An insulation displacement connector housing which receives therein an insulation displacement connector (IDC) and a wire, the housing comprising:

a dielectric body having a first side and a second side;

the first side having defined therein an opening whose shape is defined to receive the IDC; and the second side having defined therein an opening through which the wire can be received to connect to the IDC, and the second side further having defined therein a first set of features and a second set of features, the first set of features defining a shape corresponding to a shape of a BIX tool for inserting the wire and which does not correspond to or interfere with a second tool, and the second set of features defining a shape corresponding to a shape of the second tool and which does not correspond to or interfere with the first tool.

2. The housing according to claim 1 wherein the second side further has defined therein a third set of features defining a shape corresponding to a shape of a third tool for inserting the wire and which does not correspond to or interfere with the BIX tool or the second tool.

3. The housing according to claim 1, wherein the dielectric body is a single molded unitary structure.

4. The housing according to claim 3, herein the housing includes two rows of four dielectric bodies molded in a unitary structure.

5. The housing according to claim 3, wherein the housing includes a single row of four dielectric bodies molded in a unitary structure.

6. The housing according to claim 3, wherein the housing includes a single row of eight dielectric bodies molded in a unitary structure.

7. The housing according to claim 3, wherein the housing includes a single row of twenty four dielectric bodies molded in a unitary structure.

8. The housing according to claim 1, the first set of features further comprising:

a rib having a width between about 0.057 inch and 0.040 inch upon which the wire is received and a slot having a width of between about 0.047 inch and 0.043 inch which guides and supports the BIX tool.

9. The housing according to claim 8, the second tool being a type 110 tool and the second set of features further comprising:

walls of the dielectric body spaced apart by a dimension defined to accept and guide a type 110 tool head when inserted in the slot.

10. The housing according to claim 8, the second tool being a KRONE type tool and the second set of features further comprising:

wing-shaped voids defined in walls of the slot, the wing-shaped voids accepting and guiding a KRONE tool head.

11. The housing according to claim 9, the second side further having defined therein a third set of features comprising:

wing-shaped voids defined in walls of the slot, the wing-shaped voids accepting and guiding a KRONE tool head.

* * * * *